US008128178B2

(12) United States Patent
Chagnot et al.

(10) Patent No.: US 8,128,178 B2
(45) Date of Patent: Mar. 6, 2012

(54) CUTTER HEAD FOR A GROUND CUTTER MACHINE HAVING ROTARY CUTTERS

(75) Inventors: Philippe Chagnot, Nanterre (FR); Laurent Pivert, Nanterre (FR)

(73) Assignee: Compagnie du Sol, Nanterre (FR)

( * ) Notice: Subject to any disclaimer, the term of this patent is extended or adjusted under 35 U.S.C. 154(b) by 661 days.

(21) Appl. No.: 12/078,024

(22) Filed: Mar. 26, 2008

(65) Prior Publication Data

US 2008/0296959 A1 Dec. 4, 2008

(30) Foreign Application Priority Data

Mar. 28, 2007 (FR) ..... 07 54098

(51) Int. Cl.
*E02F 5/08* (2006.01)

(52) U.S. Cl. ..... 299/78; 175/96; 37/189

(58) Field of Classification Search ..... 299/79.1, 299/39.1, 39.4, 78; 37/94, 189, 462, 464, 37/352, 91, 365; 175/96, 95
See application file for complete search history.

(56) References Cited

U.S. PATENT DOCUMENTS

| | | | | |
|---|---|---|---|---|
| 4,047,763 | A * | 9/1977 | Gilliland et al. | 299/76 |
| 4,694,915 | A * | 9/1987 | Bauer et al. | 175/91 |
| 4,844,549 | A * | 7/1989 | Steff de Verninac | 175/91 |
| 4,883,134 | A * | 11/1989 | Bollinger et al. | 175/96 |
| 5,111,601 | A * | 5/1992 | Casagrande | 37/91 |
| 6,626,500 | B1 * | 9/2003 | Cribb et al. | 299/78 |

FOREIGN PATENT DOCUMENTS

| | | | |
|---|---|---|---|
| DE | 195 39 248 | A1 | 4/1996 |
| EP | 0 262 050 | A | 3/1988 |
| EP | 0 378 485 | A | 7/1990 |
| WO | WO 00/15947 | A | 3/2000 |
| WO | WO 00/36230 | A | 6/2000 |
| WO | WO 03/033826 | A | 4/2003 |

* cited by examiner

*Primary Examiner* — Sunil Singh
(74) *Attorney, Agent, or Firm* — Kenyon & Kenyon LLP

(57) ABSTRACT

The invention relates to a cutter head for a ground cutter machine having at least one cutter motor. Each cutter motor comprises:

two hydraulic motors, each comprising a stator and a rotor and having a common axis;

a single shaft extending along said common axis and having two ends;

two cutter drums mounted to rotate;

two transmission assemblies for drivingly connecting each end of the common shaft to one of said cutter drums; and mechanical members for constraining the rotor of each hydraulic motor directly in rotation with the transmission assembly corresponding to the cutter drum that is closer to the hydraulic motor.

12 Claims, 4 Drawing Sheets

CUTTER HEAD FOR A GROUND CUTTER MACHINE HAVING ROTARY CUTTERS

The present invention relates to a cutter head for a ground cutter machine having rotary cutters.

BACKGROUND OF THE INVENTION

A first type of such a machine is used for making trenches in the ground to considerable depth, up to 100 meters (m), and of width that is relatively small compared with said depth, the width typically lying in the range 500 millimeters (mm) to 1500 mm. One of the advantages of such machines is to enable such deep trenches to be made while complying with a requirement for being accurately vertical. The trench as a whole is obtained by successively digging adjacent panels.

In general, such cutter machines are constituted by a box structure of considerable height that serves to provide mechanical guidance to the excavator machine as the trench is being made. At the bottom end of the box structure there is a cutter head. These machines are themselves well known and it therefore suffices to mention that the cutter head is usually constituted by two cutter motors each usually carrying a pair of drums on which cutter tools are mounted. Each pair of drums rotates about a common axis, with the two axes of the cutter motors being parallel and horizontal in use. The cutter drums are driven in rotation by hydraulic motors.

Various types of mount are possible.

In another configuration, made available in particular by the supplier Casagrande, the hydraulic motors are located in the bottom portion of the box structure of the machine above the cutter head, and power is transmitted to the cutter drum by a transmission chain.

European patent EP 0 262 050 in the name of Soletanche, discloses a method of driving cutter drums in which the single hydraulic motor is mounted inside the cutter drums and is connected thereto by a stage of reduction gearing, or else by direct transmission. Power is delivered in hydraulic form via ducts connected to the cutter motor.

A second type of such a machine is used for making diaphragm walls molded in the ground that are obtained by cutting a trench in the ground having the shape of the wall that is to be made and by in-situ mixing the cut ground with a hydraulic binder. This technique of making diaphragm walls is known as "soil mixing".

The diaphragm wall is generally not as deep as the above-mentioned trenches. In addition, in order to enable the cutter head to be extracted from the mixture of cut ground and hydraulic binder, the box structure of the machine is of dimensions that are much smaller. Nevertheless, the cutter head of such soil mixing machines is also usually constituted by two cutter motors each carrying a pair of cutter drums.

For this type of machine, the solution adopted in particular by the supplier Bauer, has the hydraulic motor placed on the box structure above the cutter head. Power is transmitted via a small diameter shaft that is substantially vertical and that passes through the thickness of the plate forming the bearing for the cutter motor. The cylindrical shaft engages a pair of bevel gearwheels that take off motion on a horizontal axis. A system of epicyclic gearing reduces the speed of rotation and increases the torque so as to drive the cutter drum effectively.

The first and third embodiments of the ground cutter machine present the major drawback of having hydraulic motors above the cutter head and thus of mounting those motors in a manner that is more complex and more expensive. In particular, it is not possible to change the cutter heads quickly.

Furthermore, the elements of the drive transmission system for the first and third embodiments (gearing, speed reduction, chain) leads to relatively high losses, of the order of 15%, that do not occur in the configuration described in the European patent in the name of Soletanche.

In addition, when each cutter motor drives two cutter drums, it is important that different conditions in terms of the resistance to rotation of the drums due to lack of uniformity in the ground encountered by the machine should not lead to any damaging effect on the strength of the cutter motors.

OBJECTS AND SUMMARY OF THE INVENTION

An object of the present invention is to provide a cutter head for a ground cutter machine having rotary cutters that presents better performance in terms of torque and/or speed than do machines of the prior art and that improves the strength of the cutter motors.

To achieve this object, the cutter head for a ground cutter machine of the invention being constituted by at least one cutter motor that comprises:

- two hydraulic motors, each comprising a stator and a rotor and having a common axis;
- a single shaft extending along said common axis and having two ends;
- two cutter drums mounted to rotate;
- two transmission assemblies for drivingly connecting each end of the common shaft to one of said cutter drums; and
- mechanical members for constraining the rotor of each hydraulic motor directly in rotation with the transmission assembly corresponding to the cutter drum that is closer to the hydraulic motor.

It will be understood that by means of the provisions of the invention, the assembly of two cutter drums mounted on a common shaft is driven simultaneously by both hydraulic motors. This makes it possible to obtain greater power for driving a cutter drum. The shaft common to both hydraulic motors serves merely to ensure that the rotation of the two drums is synchronized when they are both in ground presenting the same resistance to cutting. This makes it easier to move excavator machine in a straight line.

In contrast, when one of the drums is blocked because of the nature of the ground, the other drum remaining free to rotate, the presence of the mechanical members providing direct connection between the jammed drum and the associated hydraulic motor avoids the portion of the common shaft between said drum and the hydraulic motor having to withstand on its own the total torque exerted by both hydraulic motors, since there is no direct mechanical connection between the rotors of the hydraulic motors and the common shaft. This direct mechanical connection transmits the torque applied by the hydraulic motor that is the closer to the jammed drum, the common shaft needing only to withstand the torque applied by the other hydraulic motor to the other drum.

In a preferred embodiment, each transmission assembly comprises a disk-shaped structure of center secured to one end of said common shaft and of periphery secured to one end of a cutter drum.

Under such circumstances, and preferably, the members providing constraint in rotation comprise clamping screws for providing friction between one face of said disk-shaped structure and one face of the rotor structure.

More preferably, the members providing constraint in rotation comprise, in addition or exclusively, pegs engaged in holes formed in the faces of the disk-shaped structure and of the rotor structure.

Furthermore, and preferably, each cutter motor comprises:

a fastener plate;

a mounting structure secured to the fastener plate and presenting a central portion and two mounting assemblies disposed on either side of the midplane of the fastener plate, each hydraulic motor being mounted in one of said mounting assemblies;

a plurality of conduits formed in the thickness of said fastener plate for passing the liquid used by the hydraulic motors; and a plurality of ducts formed in said central portion of the mounting structure, said ducts being connected firstly to said conduits and secondly to said hydraulic motors for connecting each of said motors to each of said conduits.

It will be understood that feeding fluid to, and recovering fluid from, the hydraulic motors is optimized since this fluid flow is obtained firstly by a plurality of conduits formed in the thickness of each fastener plate, and secondly via ducts formed in the central portion of the mounting structure. The hydraulic motors are thus accessible at each end of the cutter head and can thus be dismantled relatively easily.

BRIEF DESCRIPTION OF THE DRAWINGS

Other characteristics and advantages of the invention appear better on reading the following description of an embodiment of the invention given by way of non-limiting example. The description refers to the accompanying figures, in which.

MORE DETAILED DESCRIPTION

Figure 1A:
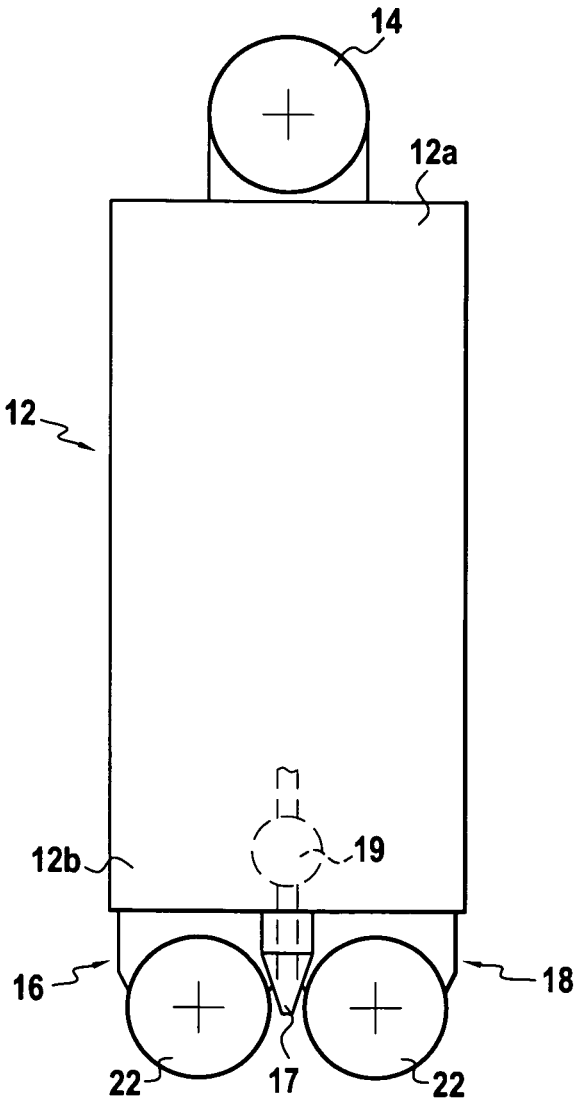
FIGS. 1A and 1B are overall views of an excavator machine of the cutter type shown in elevation view and in side view.
Figure 1B:
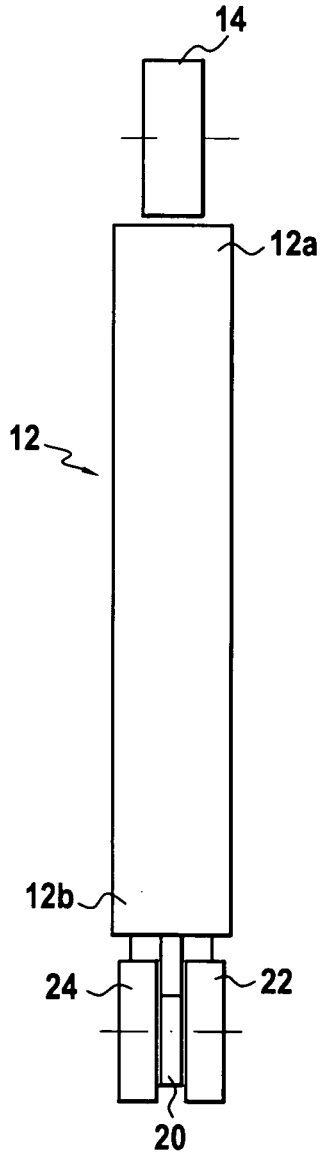

FIGS. 1A and 1B are simplified views showing the overall shape of a ground cutter for making a deep trench. The machine is constituted by a relatively long box structure 12 of horizontal section that is substantially rectangular. The top end 12*a* of the box structure is fitted with pulleys 14 over which tackle passes to support the cutter 12. At the bottom end 12*b* of the box structure 12 there are two identical cutter motors 16 and 18 forming a cutter head. Each cutter motor 16 or 18 is essentially constituted by a fastener plate 20 having mounted thereon two cutter drums 22 and 24 symmetrically about the midplane of the fastener plate 20. The invention relates to applying rotary drive to the cutter drums 22, 24 of the cutter motors 16 and 18.

There are also shown the nozzle 17 for sucking in the ground cuttings, and the pump 19 for applying the suction force.

Nevertheless, it is clear that the cutter head as defined in the description below could form a portion of a soil mixing machine. Under such circumstances, the top box structure of the machine would be lighter in weight and of dimensions much smaller than shown in FIGS. 1A and 1B. It is also clear that the suction nozzle 17 would be omitted and replaced by one or more nozzles for injecting a hydraulic binder into the ground cuttings.

As explained above, one of the essential characteristics of the invention lies in the fact that a direct rotary mechanical connection is made between the rotors of the two hydraulic motors and the mechanical transmission assembly between the common shaft of the two motors and the cutter drums.

The description of the invention made below with reference to FIGS. 2 to 4 relate to an application of the invention to a cutter motor constituted by two hydraulic motors mounted in a particular manner at the bottom end of the box structure of the ground cutter machine, regardless of whether the box structure is a large structure for making deep trenches or a lighter structure for a soil mixing machine. Nevertheless, it is clear that the invention could be applied to other cutter motors providing the cutter motors are constituted by two hydraulic motors coupled to a common outlet shaft.

Figure 2:
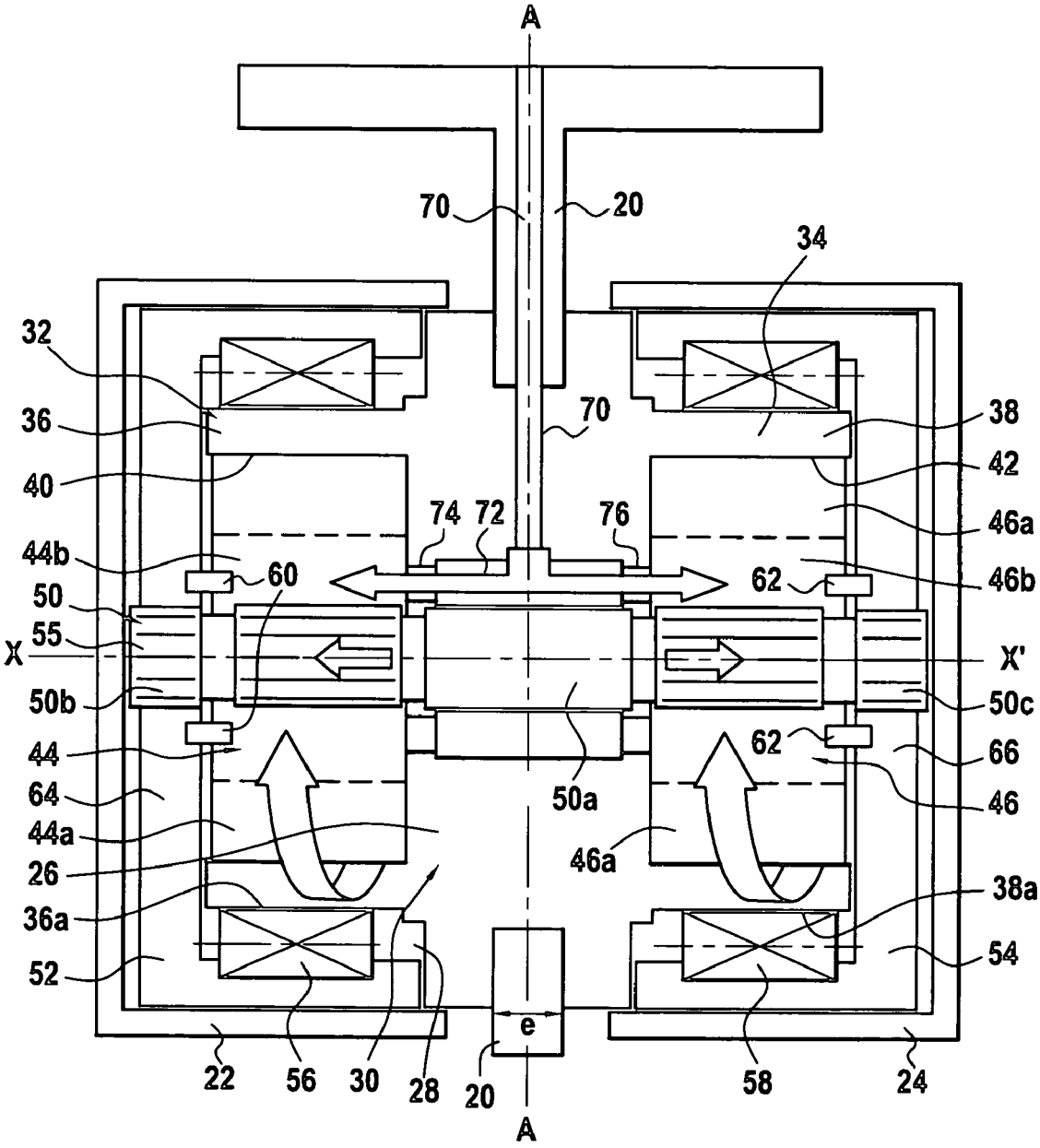
FIG. 2 is a vertical section view of a cutter motor showing its essential elements.

With reference initially to FIG. 2, there follows a description of the general organization of how a pair of cutter drums 22, 24 constituting a cutter motor are driven in rotation.

The cutter motor 16 comprises a mounting structure 26 that is secured to the fastener plate 20 and that is engaged in a circular opening 28 about an axis XX'. The mounting structure 26 has a central portion 30 that is preferably substantially symmetrical about the midplane of the fastener plate 20, and two mounting assemblies 32 and 34 extending symmetrically preferably on either side 15, of the central portion 30. In the embodiment shown, the mounting assemblies 32 and 34 are constituted by cylindrical bushings 36 and 38, thereby defining two substantially cylindrical mounting cavities 40 and 42 that are outwardly open. Inside the cavities 40 and 42, which are preferably but not necessarily identical, there are mounted the hydraulic motors 44 and 46. Each hydraulic motor comprises a stator 44*a*, 46*a* and a rotor 44*b*, 46*b*. Each rotor 44*b* and 46*b* surrounds a common shaft 50 of axis coinciding with the axis XX' that is also the axis of the rotors of the hydraulic motors. The middle portion 50*a* of the shaft 50 passes through the central portion 30 of the mounting structure via a suitably provided bore. The ends 50*b* and 50*c* of the shaft 50 are secured to drive parts or rims 52 and 54. This is preferably done by means of splines 55. The cutter drums 22 and 24 are mounted on the rims 52 and 54. The rims 52 and 54 are guided and supported in rotation by bearings 56 and 58 which are themselves mounted on the outside faces 36*a*, 38*a* of the bushings 36 and 38 forming the mounting assemblies of the hydraulic motors. The function of the bearings 56 and 58 is essentially to take up the forces applied by the cutter drums during cutting operations.

In addition, in accordance with the invention, mechanical members such as 60 and 62 provide a direct rotary connection respectively between the rotors 44*b* and 46*b* of the hydraulic motors 44 and 46 and also covers 64 and 66 constituting portions of the rims 52 and 54 which connect the ends of the shaft 50 to the cutter drums 22 and 24. Thus, the cutter drums are constrained to rotate with the rotors of the motors by the mechanical systems 60 and 62. An embodiment of these mechanical members is described below with reference to FIG. 4. The shaft 50 merely interconnects the two cutter drums.

The liquids needed for the operation of the hydraulic motors and their environment are caused to flow in the following manner. Conduits such as 70 are drilled in the thickness of the fastener plate 20. One of their ends is connected to feed or removal conduits disposed on the structure of the cutter, and their bottom other ends are connected to ducts shown diagrammatically at 72 in FIG. 2. As explained below in the embodiment in question, there are five feed conduits 70 corresponding respectively to feeding the hydraulic motors with high pressure, returning oil at low pressure from the hydraulic pressures, draining leaks internal to the hydraulic motors, and to an oil conduit serving to transmit balancing pressure to the sealing gaskets of the cutter motor in order to prevent drilling mud from penetrating into the insides of the cutter motors themselves.

The ducts such as 72 are formed in the central portion 30 of the mounting structure. These ducts are preferably symmetrical for feeding or recovering liquids in the same manner for both hydraulic motors 44 and 46.

Insofar as the ducts 72 serve to feed rotary portions of the hydraulic motors, these ducts terminate in distributor systems such as 74 and 76, referred to as "faces", that provide a rotary connection between the feed ducts and the hydraulic inlets or outlets of the rotors 44*b* and 46*b*.

It can be understood that insofar as each duct 72 feeds the faces 74 and 76 corresponding to the two hydraulic motors 44 and 46 symmetrically, the pressure exerted by the liquid or oil on the feed faces of the hydraulic motors 44 and 46 are identical and therefore balanced axially. One of the advantages of this configuration is thus avoiding any need to install bearings or abutments to take up axial thrust along the direction of the axis XX' that might would otherwise be due to the feed liquids.

Figure 3:
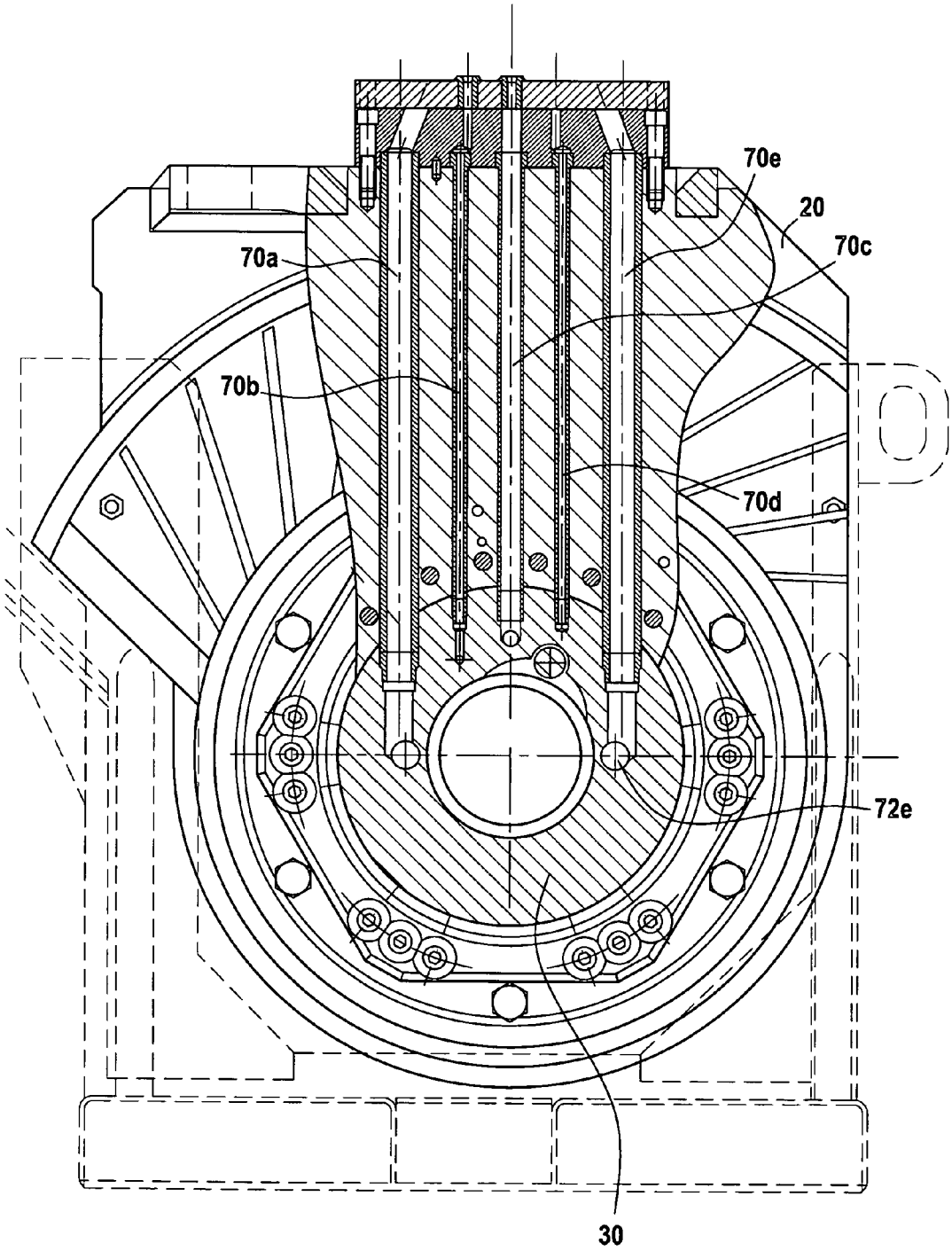
FIG. 3 is a view of a cutter motor in section on line A-A of FIG. 2.

FIG. 3 shows the conduits 70 and the ducts 72 in greater detail. In particular, there can be seen the five feed conduits 70*a* to 70*e* formed in the thickness of the fastener plate 20.

The bottom ends of the conduits 70*a* to 70*e* are connected to the ducts 72*a* to 72*e* that extend symmetrically in the central portion 26 of the mounting structure. The ends of the ducts open out in the faces for communicating with the rotary portions of the hydraulic motors. The ducts 72*a* to 72*e* used for feeding high pressure and for exhausting low pressure to and from the hydraulic motors 44 and 46 are situated at the same distance from the axis XX' of the central portion 26.

Figure 4:
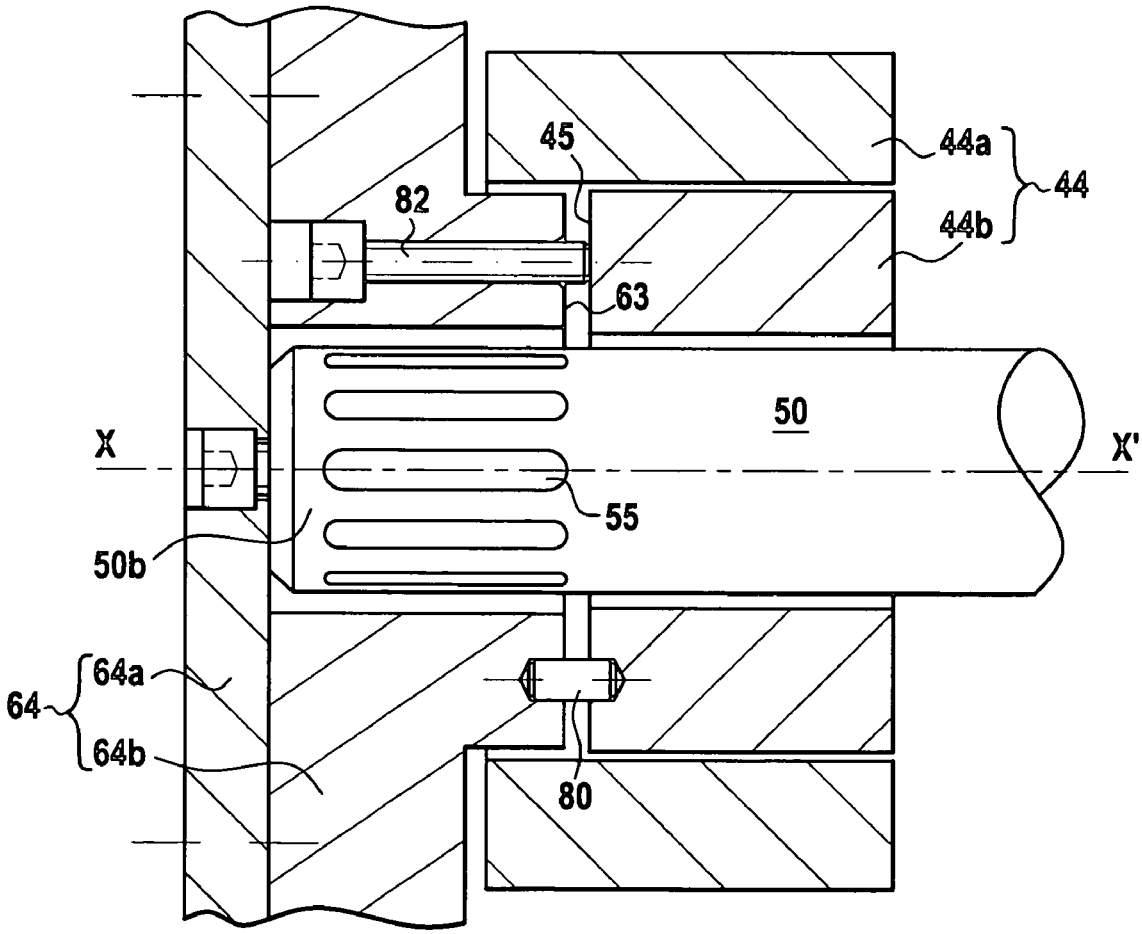
FIG. 4 is a detail view of FIG. 2 showing a preferred embodiment of the direct mechanical connection means.

FIG. 4 shows in greater detail a portion of a preferred embodiment of the mechanical members for providing a direct rotary connection between a cutter drum and the hydraulic motor with which it is associated.

In the figure, there can be seen one of the two hydraulic motors 44 together with its rotor 44*b*. The end 50*b* of the shaft is secured to the cover 64 that forms a portion of the rim 52 on which one of the cutter drums 22 is mounted (not shown in this figure). The end face 45 of the rotor structure 44*b* is secured to the cover 64 of the rim 52 by mechanical members referenced 60 and 62 in FIG. 2.

In the embodiment shown in FIG. 4, each cover 64 is constituted by two bolted-together parts 64*a* and 64*b*.

The mechanical members 60 and 62 are preferably constituted by alternating pegs 80 and screws 82 that are regularly disposed around the axis XX' of the hydraulic motors.

The function of the screws 80 is to provide a high level of friction between the end face 45 of the rotor 44*b* and the inside face 63 of the cover 64 so as to constrain the rotor to rotate with the rim 52.

The function of the pegs 80 is to add to the connection provided by the screws 82, should that be necessary. They are received in blind holes formed in the face 45 of the rotor of each hydraulic motor and in blind holes formed in the inside face 63 of the cover of the rim.

Other mechanical connection members could be used providing they are capable of absorbing the torque that can be generated in the event of the drum associated with the connection system becoming jammed.

What is claimed is:

1. A cutter head for a ground cutter machine having at least one cutter motor, each cutter motor comprising:

two hydraulic motors, each comprising a stator and a rotor and having a common axis;

a single shaft extending along said common axis and having two ends;

two cutter drums mounted to rotate;

two transmission assemblies for drivingly connecting each end of the common shaft to one of said cutter drums; and mechanical members for fixing the rotor of each hydraulic motor directly with the transmission assembly corresponding to the cutter drum that is closer to the hydraulic motor, whereby the rotors of the hydraulic motors are directly fixed to the transmission assemblies so there is no relative movement between the rotor of each hydraulic motor and the cutter drum that is closer to the hydraulic motor during rotation of the rotor.

2. A cutter head according to claim 1, in which each transmission assembly comprises:

a disk-shaped structure having its center secured to one end of said common shaft and having its periphery secured to one of a cutter drum.

3. A cutter head according to claim 2, further comprising:

clamping screws for providing friction between a face of said disk-shaped structure and a face of the rotor structure.

4. A cutter head according to claim 3, in which said mechanical members comprise:

pegs engaged in holes formed in said face of said disk-shaped structure and said face of said rotor structure.

5. A cutter head according to claim 2, in which the rotor has a structure including a face and the disk-shaped structure presents a face, said mechanical members comprising pegs engaged in holes formed in said faces.

6. A cutter head according to claim 1, in which each cutter motor further comprises:

a fastener plate;

a mounting structure secured to the fastener plate and presenting a central portion and two mounting assemblies disposed on either side of the midplane of the fastener plate, each hydraulic motor being mounted in one of said mounting assemblies;

a plurality of conduits formed in the thickness of said fastener plate for passing a liquid used by the hydraulic motors; and a plurality of ducts formed in said central portion of the mounting structure, said ducts being connected firstly to said conduits and secondly to said hydraulic motors for connecting each of said motors to each of said conduits.

7. A cutter head according to claim 6, in which the two hydraulic motors are substantially identical and in which they are substantially symmetrical about the midplane of the fastener plate.

8. A cutter head for a ground cutter machine having at least one cutter motor, each cutter motor comprising:

two hydraulic motors, each comprising a stator and a rotor and having a common axis;

a single shaft extending along said common axis and having two ends;

two cutter drums mounted to rotate;

two transmission assemblies for drivingly connecting each end of the common shaft to one of said cutter drums; and mechanical members for constraining the rotor of each hydraulic motor directly in rotation with the transmission assembly corresponding to the cutter drum that is closer to the hydraulic motor, wherein each transmission assembly comprises a disk-shaped structure having its center secured to one end of said common shaft and having its periphery secured to one of the cutter drums, and wherein the mechanical members for providing constraint in rotation comprise clamping screws for providing friction between a face of said disk-shaped structure and a face of the rotor structure.

9. A cutter head according to claim 8, in which said mechanical members further comprise pegs engaged in holes formed in said face of said disk-shaped structure and said face of said rotor structure.

10. A cutter head according to claim 8, in which each cutter motor further comprises:

a fastener plate;

a mounting structure secured to the fastener plate and presenting a central portion and two mounting assemblies disposed on either side of the midplane of the fastener plate, each hydraulic motor being mounted in one of said mounting assemblies;

a plurality of conduits formed in the thickness of said fastener plate for passing the liquid used by the hydraulic motors; and a plurality of ducts formed in said central portion of the mounting structure, said ducts being connected firstly to said conduits and secondly to said hydraulic motors for connecting each of said motors to each of said conduits.

11. A cutter head for a ground cutter machine having at least one cutter motor, each cutter motor comprising:

two hydraulic motors, each comprising a stator and a rotor and having a common axis;

a single shaft extending along said common axis and having two ends;

two cutter drums mounted to rotate;

two transmission assemblies for drivingly connecting each end of the common shaft to one of said cutter drums; and mechanical members for constraining the rotor of each hydraulic motor directly in rotation with the transmission assembly corresponding to the cutter drum that is closer to the hydraulic motor, wherein each transmission assembly comprises a disk-shaped structure having its center secured to one end of said common shaft and having its periphery secured to one of the cutter drums, and wherein the rotor has a structure including a face and the disk-shaped structure presents a face, said mechanical constraining members comprising pegs engaged in holes formed in said faces.

12. A cutter head according to claim 11, in which each cutter motor further comprises:

a fastener plate;

a mounting structure secured to the fastener plate and presenting a central portion and two mounting assemblies disposed on either side of the midplane of the fastener plate, each hydraulic motor being mounted in one of said mounting assemblies;

a plurality of conduits formed in the thickness of said fastener plate for passing the liquid used by the hydraulic motors; and a plurality of ducts formed in said central portion of the mounting structure, said ducts being connected firstly to said conduits and secondly to said hydraulic motors for connecting each of said motors to each of said conduits.

* * * * *